United States Patent [19]

Kircher

[11] 4,390,408

[45] Jun. 28, 1983

[54] MEMBRANE ELECTRODE PACK CELLS DESIGNED FOR MEDIUM PRESSURE OPERATION

[75] Inventor: Morton S. Kircher, Clearwater, Fla.

[73] Assignee: Olin Corporation, New Haven, Conn.

[21] Appl. No.: 278,226

[22] Filed: Jun. 29, 1981

Related U.S. Application Data

[63] Continuation-in-part of Ser. No. 157,918, Jun. 6, 1980, Pat. No. 4,313,812, which is a continuation-in-part of Ser. No. 128,684, Mar. 10, 1980, abandoned, and Ser. No. 143,969, Apr. 25, 1980, Pat. No. 4,312,737.

[51] Int. Cl.[3] ..... C25B 11/03

[52] U.S. Cl. ..... 204/284

[58] Field of Search ..... 204/252-258, 204/263-266, 283, 284, 288, 289, 279, 128

[56] References Cited

U.S. PATENT DOCUMENTS

| | | | |
|---|---|---|---|
| 3,864,226 | 2/1975 | Spitzer | 204/98 |
| 4,036,714 | 7/1977 | Spitzer | 204/99 |
| 4,105,515 | 8/1978 | Ogawa et al. | 204/98 |
| 4,111,779 | 9/1978 | Seko et al. | 204/255 |
| 4,175,025 | 11/1979 | Creamer et al. | 204/253 |
| 4,207,165 | 7/1980 | Mose et al. | 204/258 |
| 4,210,516 | 7/1980 | Mose et al. | 204/284 |
| 4,217,199 | 8/1980 | Cunningham | 204/256 |

*Primary Examiner*—John F. Niebling

*Attorney, Agent, or Firm*—Ralph D'Alessandro; Donald F. Clements; Thomas P. O'Day

[57] ABSTRACT

In an electrode designed for use in a filter press membrane cell there is provided a frame of predetermined thickness that on opposing sides has generally planar foraminous electrode surfaces reinforcingly attached thereto, the electrode surfaces each having a predetermined surface area. The ratio of the predetermined surface area to the frame thickness for each electrode can vary in the range of about $12.05 \times 10^4$ linear units to about $0.08 \times 10^4$ linear units.

18 Claims, 6 Drawing Figures

MEMBRANE ELECTRODE PACK CELLS DESIGNED FOR MEDIUM PRESSURE OPERATION

This application is a continuation-in-part of co-pending application Ser. No. 157,918, filed June 6, 1980, U.S. Pat. No. 4,313,812, entitled "Membrane Electrode Pack Cells Designed for Medium Pressure Operation" which is in turn a continuation-in-part application of application Ser. No. 128,684, filed Mar. 10, 1980 now abandoned, entitled "Membrane-Electrode Pack Alkali Chlorine Cell" and of application Ser. No. 143,969, filed Apr. 25, 1980, U.S. Pat. No. 4,312,737 entitled "Electrode for Monopolar Filter Press Cells".

This invention relates to electrodes and electrolytic cell assemblies of membrane type filter press electrolytic cells and more particularly to electrodes and electrolytic cell assemblies of monopolar electrolytic filter press cells which may be efficiently operated at medium pressure. The term "medium pressure" is employed throughout the description and claims to define the operating pressure of the electrolytic cell as measured or calculated from measurements taken at the point of highest pressure in the cell interior and is in the range from about 16 to about 80 pounds absolute pressure per square inch. Specifically, the invention relates to the ratio of the predetermined electrode surface area of each electrode to the thickness of the individual frames and the reinforcing manner in which the electrode surfaces are attached to the frame.

Commercial electrolytic cells for the production of halogens such as chlorine and for aqueous solutions of alkali metal hydroxides such as aqueous solutions of potassium hydroxide and aqueous solutions of sodium hydroxide have been continually developed and improved over a long period of time. During the past few years, developments have been made in cells employing ion exchange membranes which promise operating advantages over traditional diaphragm or mercury cells. It is necessary to provide cell designs which meet the requirements of the membranes. Since suitable membrane materials such as those manufactured and marketed by E. I. duPont de Nemours and Company under the trademark Nafion® and those marketed by Asahi Glass Company Ltd. under the trademark Flemion™ are available principally in sheet form, the most generally used type of the membrane cells are of the filter press type. In the filter press type of electrolytic cell, membranes are positioned between adjacent filter press frames. The construction and operation of typical prior art filter press cell is described generally in U.S. Pat. No. 4,175,025 issued to Edward D. Creamer et al on Nov. 20, 1979. The teaching of that patent is incorporated herein in its entirety by reference.

Generally, the prior art has given considerable attention to the electrode coating materials, diaphragm or ion exchange membrane composition and the like. As a result, little attention has been directed to much needed improvements for reducing cell frame cost and to designing filter press membrane cell electrodes of compact design with sufficient strength for the necessary electrode surface area.

As the available electrode surface area for each electrode in a filter press membrane cell has increased, the hydraulic pressure to which the electrode frame is subjected has also increased. In some instances it has been found that the electrode frames have had insufficient strength to withstand the hydraulic pressure, resulting in the outward deformation of the frames. This bulging outward or deformation, if severe enough, can cause the sealing gaskets between the membranes and the adjacent frames to pop out, breaking the seals between the frames.

The problem of adequate sealing is particularly acute in chlor-alkali filter press cells. Since the anode side of the membrane contains hot chlorinated brine (85° C.) which is highly corrosive, and the cathode side of the same membrane contains hot sodium hydroxide (85° C.), leaks of either material can present a safety hazard.

Because of the very high cost of present filter press cell construction materials, such as titanium, ruthenium, nickel, and the fluorocarbon and carobyxlic acid substituted membranes, among others, it is highly desirable to maximize current densities and to reduce voltage coefficients in operating chlor-alkali cells and to utilize to best mechanical and electrical advantage the materials employed.

U.S. Pat. No. 4,105,515 issued to Shinsaku Ogawa et al on Aug. 3, 1978 discloses that higher current densities can be obtained at reduced cell voltage coefficients and higher temperatures by maintaining the pressure sufficiently high to avoid flashing of water to steam in the membranes of the electrolytic cell. The teachings of that patent is incorporated herein in its entirety by reference.

The sealing structure used for pressure operation in U.S. Pat. No. 4,105,515, supra, presumably is the same as disclosed in U.S. Pat. No. 4,111,779 issued to Maomi Seko et al on Sept. 5, 1978. Although pressure operation is not specifically mentioned in this latter patent, the above disclosure appears to relate to pressure operation. The back plate of each bipolar electrode unit is a titanium to steel explosion bonded plate. Heavy steel flanges welded to the back plate complete a unit appearing capable of containing substantial pressure. However, the construction of such a titanium clad steel structure which requires extraordinary measures for minimizing warpage and other dimensional tolerations appears inherently very costly.

U.S. Pat. Nos. 3,864,226 and 4,036,714 issued to Robert Spitzer on Feb. 4, 1975 and July 19, 1977, respectively, disclose pressure cells which are operated at sufficiently high pressure that chlorine may be recovered as a liquid. These patents disclose cells containing composite ion exchange membranes—mercury, layers in interfacial contact in a horizontal orientation. The structures outlined are ring closures in which hoop stress contains the pressure. The patents also disclose rectangular rings but no disclosure is made of the structural design. With large scale unit rectangles, very high construction or internal support appears a likely requirement.

In general, then, cell construction which has been used, or proposed, as in the aforementioned patents for pressure operation has required heavy member construction and/or cylindrical shape. Heavy member construction, either with solid wall resistant metals, such as titanium and nickel, or with steel-lined resistant metal, tends to be very expensive and consumes large amounts of metal. For this reason, pressure type chlor-alkali cells have not been developed commercially, beyond a major fraction of 1% of the total North American chlor-alkali production. Construction, based on circular electrodes within a cylindrical container with dished heads, has been proposed as a means of meeting pressure demands more economically. However, since major items, such as electrode materials and ion exchange membranes are inherently produced in rectangular sheet form, the waste involved in cutting to conform these materials to circular configuration is a very serious deterrent to the use of circular electrodes.

The foregoing problems are solved in the design of the present invention by providing an electrode for use in a filter press membrane type of cell that has generally foraminous electrode surfaces attached to the opposing sides of the electrode frame in a reinforcing manner, the frame having a predetermined thickness and the electrode surfaces having a predetermined surface area such that the ratio of the electrode surface area to the frame thickness is within a desired range.

SUMMARY OF THE INVENTION

A principal object of the invention is to provide an electrode having two foraminous electrode surfaces and a lightweight frame yet having adequate strength for use in a medium pressure filter press chlor-alkali cell.

It is another object of this invention to provide in a filter press membrane electrolytic cell an electrode design in which the electrode surface area may be increased in size in the plane of the electrode surfaces without increasing the stress in the electrode frames.

It is a feature of the present invention that the electrode frames are made of thin-walled resistant metal.

It is another feature of the present invention that the electrode mesh which comprises the electrode surfaces provides structural stiffness to the electrode frame and permits the use of thin or narrow width electrode frames in the design of the filter press membrane electrolytic cell of the present invention.

It is another feature of the present invention that the filter press membrane electrolytic cell of the instant invention utilizes the electrode surfaces to provide the principal support retaining the individual electrode frame elements to contain the internal hydraulic pressure within the cell.

It is an advantage of the present invention that the height and length of the individual electrode units in the plane of the electrode surfaces are not limited by the allowable stresses in the individual electrode frame members.

It is an additional advantage of the filter press membrane cell of the instant inventive design that large, high current density cells may be utilized at decreased unit construction costs.

BRIEF DESCRIPTION OF THE INVENTION

These and other objects, features and advantages are achieved in an electrode for a filter press electrolytic cell, wherein the electrode of the instant invention comprises a frame having two side members, a top member and a bottom member with the frame having a tensile strength in the range from about 1200 to about 6000 pounds per lineal inch. At least two vertical planar electrode foraminous surfaces conforming generally to the shape of the frame are employed. A first of the surfaces is positioned parallel to one side of the frame and the other surface is positioned parallel to an opposite side of the frame. The surfaces are connected along their peripheries to the opposing sides of the frame, thereby forming a chamber between the interior confines of the surfaces bounded by the frame.

The foraminous surface has a tensile strength in the range from about 50 to about 300 pounds per lineal inch measured in the weakest direction of the foraminous surface. The connection between the peripheries of the surfaces and the opposing sides of the frame has a tensile strength in the direction of the plane of the foraminous surface greater than or equal to the tensile strength of the foraminous surface itself. At least one process connection exists in the frame for conveying process material into or out of the chamber. At least one pair of conductor rods pass through one of the side members of the frame and is attached to the foraminous surfaces. This individual electrode design thus utilizes the foraminous electrode surfaces, preferably mesh, to provide structural stiffness or rigidity which supports the individual electrode frame to contain the hydraulic pressure within the cell. The thickness of the individual electrode frames is more a limiting factor practically in designing a filter press membrane electrolytic cell of the instant invention than is the electrode surface area per frame. Expressed as a ratio, the predetermined surface area of each electrode over the thickness of each electrode frame is in the range of about $12.05\times10^4$ linear units to about $0.08\times10^4$ linear units.

BRIEF DESCRIPTION OF THE DRAWINGS

The invention will be better understood by references to the attached Drawings in which.

DETAILED DESCRIPTION OF THE PREFERRED EMBODIMENT

Figure 1:
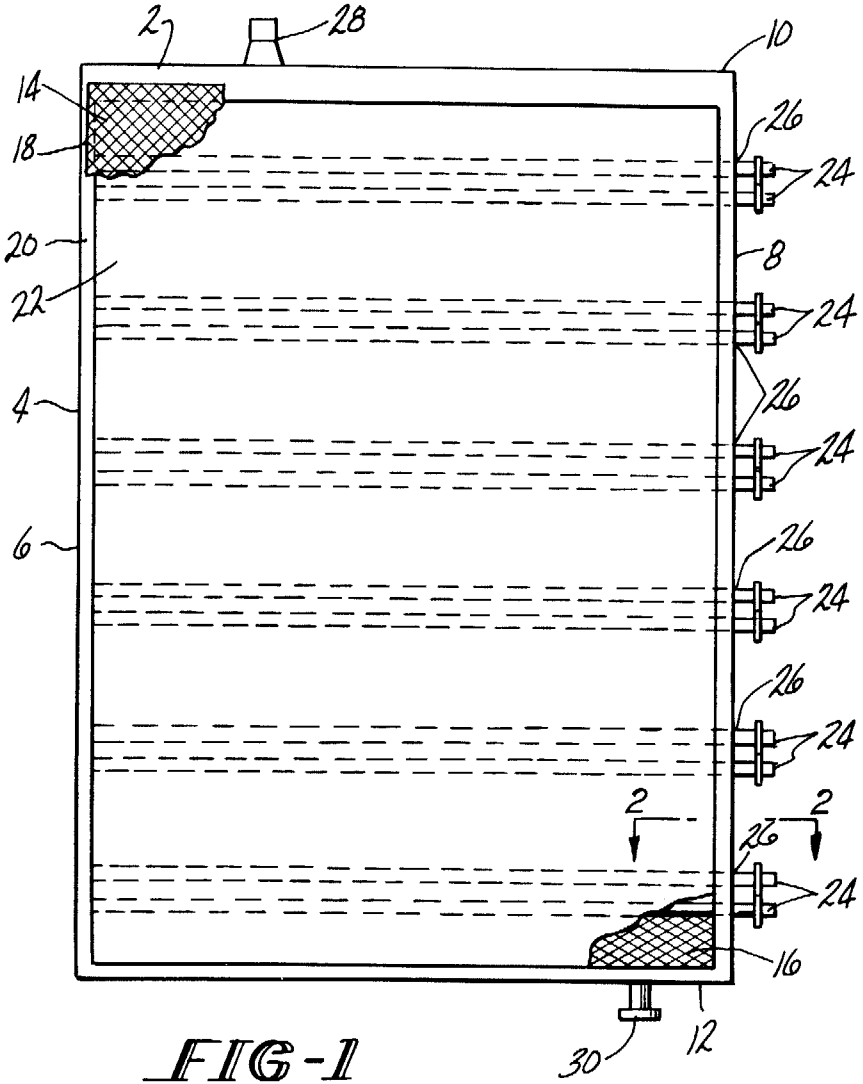
FIG. 1 is a cutaway view of the novel electrode of this invention.

As shown in FIG. 1, a preferred construction of the novel electrode 2 of this invention comprises frame 4 having two side members 6 and 8, top member 10 and bottom member 12. Two vertical planar electrode surfaces 14 and 16 (partial cutaway) conform in shape to frame 4. Electrode surfaces 14 and 16 are foraminous surfaces. Surfaces 14 and 16 are positioned in parallel but are spaced apart and are connected along their peripheries to the opposing sides of the members 6, 8, 10 and 12 of frame 4. As seen in FIG. 1 the electrode surface 14 is connected along its periphery to side 20 of frame 4, typically by a continuous welded connection and generally by a lap welded connection. Chamber 22 is formed between surfaces 14 and 16 and is bounded by frame 4. Electrical conductor 24 is attached to frame 4 at position 26. Process connections 28 and 30 are employed for conveying process material (not shown) into or out of chamber 22.

Foraminous surfaces 14 and 16 may be in various forms for example a screen, mesh, perforated plate, or an expanded vertical mesh which is flattened or unflattened and having slits horizontally, vertically, or angularly. The term mesh includes any structure having a plurality of longitudinal members and a plurality of traverse members, joining together at junctures where the members cross each other. Other suitable forms of foraminous surfaces 14 and 16 include woven wire cloth, which is flattened or unflattened, bars, wires or strips arranged for example vertically, and sheets having perforations, slits or louvered openings. A preferred electrode surface 14 is a foraminous metal mesh having good electrical conductivity in the vertical direction.

Many different types of construction of foraminous surfaces 14 and 16 are suitable in this invention. The number of openings in the surface is in the range from about 8 to about 40, and preferably from about 10 to about 20 per square inch. The thickness of the foraminous surfaces 14 and 16 is typically in the range from about 0.03 to about 0.10 and preferably from about 0.05 to about 0.08 inches.

The length to width ratio of the openings in the foraminous surfaces 14 and 16 is typically in the range from about 5:1 to about 1:1 and preferably from about 3:1 to about 1.2:1. The length to width ratio of the openings in the foraminous surfaces 14 and 16 is an important factor because it is related to both the strength and the conductivity of the foraminous surfaces 14 and 16 in one direction as compared with the strength and conductivity of the foraminous surfaces 14 and 16 in a second direction perpendicular to the first direction, both directions being in the same plane of each of the foraminous surfaces 14 and 16.

Foraminous surfaces 14 and 16 may be employed as an anode surface, or a cathode surface. Foraminous surface 14, when employed as an anode electrode surface in an electrolytic cell, is typically a conductive foraminous sheet of valve metal, such as titanium, coated with an activating material. The preferred cathode surface is also foraminous and usually made of steel. Iron, stainless steel, nickel, copper, and various alloys of these and other metals may also be used with special activating coatings. In addition to good low overvoltage properties, adequate conductivity and good corrosion resistance, the electrode surfaces must have sufficient tensile strength for the designed operating pressure of the cell.

As shown in FIG. 1, frame 4 surrounds and bounds chamber 22. The electrode frame 4 is shown to be of rectangular picture-frame type configuration with four peripheral members 6, 8, 10, and 12 and two parallel, foraminous surfaces 14 and 16 attached to the front and back of the frame, respectively. These frame members 6, 8, 10, and 12 may be in the shape of rectangular bars, U channels, elliptical tubes as well as being I-shaped or H-shaped. An inverted U channel construction (not shown) is preferred for the top member 10 in order to allow the top member 10 to serve as a gas collector. Preferably, this top inverted channel is generally reinforced at its open bottom to prevent bending, buckling, or collapse. The remaining members 6, 8, and 12 could be of any suitable configuration which would allow the frame 4 to be pressed together against a gasket (not shown) in order to achieve a fluid-tight cell (not shown). While a flat front and rear surface is preferable for the members, it would be possible to have many other configurations such as round or even ridged channels. The electrode surfaces 14 and 16 shown in FIG. 1 may be welded to the outside of the periphery members 6, 8, 10 and 12 of frame 4, or may be welded to the front and back outside surfaces provided that the joint does not interfere with gasket sealing when the electrode surfaces were on the outside rather than inside.

The overall size of the electrode frame is expressed in terms of length by height and in the range from about a size of 0.5 meter by 0.5 meter to a size of about 4 meters by 3 meters, and preferably from a size of about 1 by 1 meter to a size of about 3 to 2 meters and most preferably from a size of about 1.5 by 1.1 meters to a size of about 2 by 1.5 meters.

The thickness of the electrode frames 4, e.g., the distance from the inner surface of foraminous surface 14 to the inner surface of adjacent foraminous surface 16 is more sensitive to the frame size range than other dimensions, especially when thinner frame material thicknesses (gauge) are desired to conserve frame material. The hydraulic force exerted by the internal pressure of the electrolytic fluid within the cell on the frame elements of the individual electrode units is directly proportional to the thickness of the chamber 22. In contrast, the resisting force exerted by the electrode surface area or mesh is limited to the allowable tensile strength of the mesh which is a constant, dependent upon the material thickness and other characteristics. This electrode mesh provides the principal support in retaining the frame to withstand the hydraulic pressure within the cell.

While the height or length of the frame may be easily increased, without using thicker frame material (i.e., heavier gauge material), increasing the thickness of the frame without increasing the thickness (or gauge) of the material employed therein may result in buckling of the frame or additional frame reinforcing material being required. It is therefore desired to maintain the thickness of the frame in the range from about 2 to about 10, preferably from about 2.5 to about 6, and most preferably from about 3 to about 5 centimeters wherein the aforementioned frame sizes are employed.

The hydraulic force exerted by the internal pressure of the cell outward on frame 4 is the product of the operating pressure at that point, the height or length, as applicable, of the frame and the thickness of the frame. The resisting force that the electrode surfaces 14 and 16 exert in response to the outward hydraulic pressure is limited to the allowable tensile strength for the material and structure employed for foraminous surfaces 14 and 16. The term "tensile strength" is a measure of the maximum resistance to deformation and as it is employed throughout the claims and description means the maximum allowable load divided by the length of section of material normal to the load. Generally, the narrower the thickness of the frame 4, the smaller is the hydraulic force pushing outwardly within each frame. The design of the individual frame therefore is a balance between the release or separation capacity of the gas within the electrolyte fluid and the frame thickness. Too thin a frame could cause excessive foaming. Additionally, a minimum thickness must be allowed to permit the conductor rods 24 to be of a size or diameter sufficient to permit insertion through the peripheral or side member 8 into the chamber 22. Also, the individual electrode frames 4 must be of sufficient thickness to permit process connections 28 and 30 to be appropriately assembled to permit process material to be conveyed into or out of the chamber 22.

The size of the electrode units in the plane of the electrode surfaces is not believed to be limited by the allowable stresses in the container shell or the individual frame members 6, 8, 10, and 12 of electrode frame 4 in the instant invention. In the instant design, it is believed that increase in electrode dimension, in the plane of the electrode surfaces, results in no substantial, additional stress in the frame because of the reinforcing manner in which the foraminous surfaces 14 and 16 are fastened to the individual members of the frame 4. This makes possible large, high current density cells at decreased unit construction cost.

The number of electrode frames per cell unit (including cathode and anode) is in the range from about 3 to about 50, preferably from about 5 to about 30 and most preferably from about 7 to about 15.

The construction material of electrode frame 4 is preferably of metal of the same type as the electrode surfaces 14 and 16. For example, titanium may be employed for the anode frame and nickel may be employed for the cathode frame. This choice of material allows for direct resistance welding of the foraminous surface 14 to the frame 4. The thickness or gauge of the material used to construct the frame 4 must be calculated for the specific design pressure. In general, the thickness or gauage of the frame 4 material is in the range from about 0.05 to about 0.15 inches. The tensile strength of the frame 4 is equal to or greater than the tensile strength of the foraminous surfaces 14 and 16.

Although not of primary consideration in the design of the instant invention, it should be recognized that the frame 4 must be designed with sufficient tensile strength to withstand the deformation pressures to which it is subjected from gasket compression. The forces exerted to compress the gaskets between adjacent electrode frames in the assembled cell to form fluid-tight seals therebetween can cause the members 6, 8, 10, and 12 of the frame 4 to buckle inwardly if underdesigned.

The frame 4 of the novel electrode of the present invention is connected to a plurality of conductor rods 24. The conductor rods 24 extend through a side of the electrode frame 4 and into the chamber 22 between the electrode surfaces 14 and 16. Within the chamber 22, the conductor rods 24 may be positioned substantially horizontal or sloped. At least one end of the conductor rods 24 is attached to the electrode collectors (not shown). In another embodiment, the conductor rods 24 have a first portion which is substantially horizontal for attachment to the electrode collectors (not shown) and a second portion (not shown) within chamber 22 which is sloped or curved. The shape or curvature of this second portion may be, for example, from about 1 to about 30, and preferably from about 2 to about 10 degrees from the horizontal, referenced from the horizontal portion for attachment to the electrode collectors. While the term "conductor rod" has been employed, the actual conductors may be in any convenient physical form such as rods, bars, or strips. While rods having a circular cross section are preferred, other shapes such as flattened round, ellipses, etc. may be used.

Where the electrode 2 of the present invention is employed as anodes, for example, in the electrolysis of alkali metal chloride brines, the conductor rods 24 are suitably fabricated from a conductive metal such as copper, silver, steel, magnesium, or aluminum covered by a chlorine-resistant metal such as titanium or tantalum. Where the electrodes serve as the cathodes, the conductor rods are suitably composed of, for example, steel, nickel, copper, or coated conductive materials such as nickel coated copper.

The electrode area may be increased in size in the plane of the electrode surfaces, without increasing the stress in the frame 4. Since relatively high pressure and high current density operation increases production capacity, the electrode design of the instant invention offers the opportunity of making very large cells with low unit cost. For instance, electrodes of about 2 meters by 2 meters size with 20 anodes and 21 cathodes, operating at about 1 to about 4 $KA/M^2$ would operate at about 160 to about 640 KA, i.e., with a capacity in the range from about 0.5 to about 30, preferably from about 1 to about 15, and most preferably from about 5 to about 10 tons chlorine per cell per day.

Figure 2:
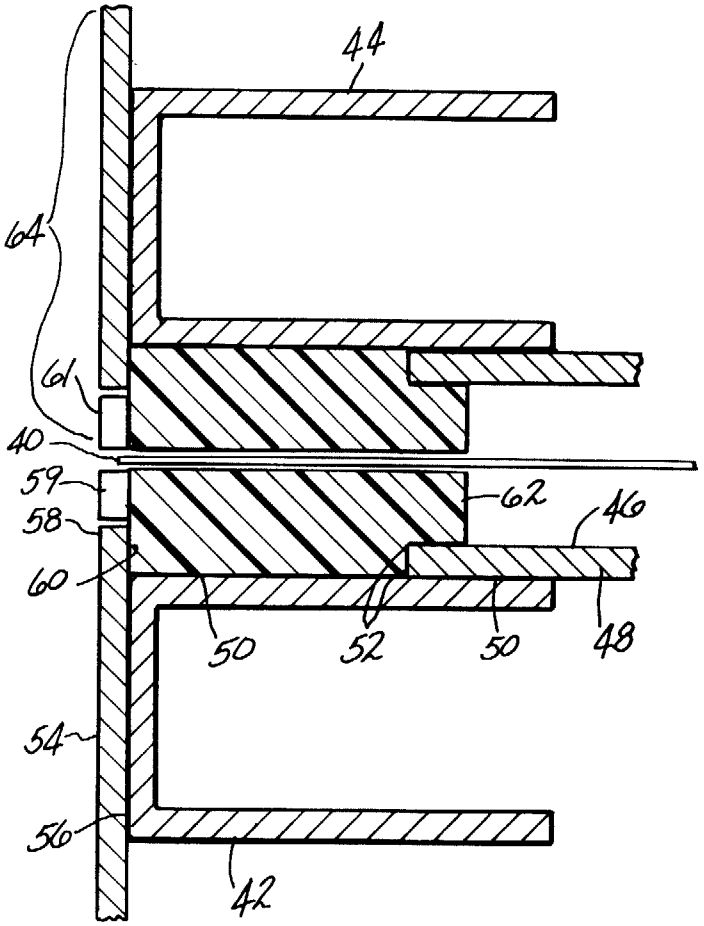
FIG. 2 is an enlarged horizontal cross-section through the electrode of FIG. 1 taken along lines 2—2 showing one preferred electrolytic cell assembly having a gasket retaining member.

Referring to FIG. 2, a preferred electrolytic cell assembly comprises a separator 40 (such as a membrane) formed to fit between first frame 42 and adjacent second frame 44. When in assembled position, a planar layer 46 of electrode surface material 48 conforms in shape to first frame 42 and has smaller external dimensions than first frame 42. Layer 46 is fixedly fastened to side 50 of electrode frame 42. A portion of layer 46 overlaps side 50 of electrode frame 42, creating an outwardly facing shoulder 52 adjacent side 50 of first frame 42.

A gasket retaining member 54 is affixed to the outside 56 of first frame 42 and has at least one straight projection 58 beyond side 50 toward second adjacent frame 44 so as to form an inwardly facing shoulder 60 on side 50 of first frame 42. A gasket 62 is adapted to fit against side 50 of first frame 42 and between outwardly facing shoulder 52 and inwardly facing shoulder 60 so as to seal the space between outwardly facing shoulder 52, side 50, inwardly facing shoulder 60 and separator 40. Spacers 59 and 61 may be employed to insulate gasket retaining member 54 from the gasket retaining member of the adjacent frame 44 and to allow proper frame to frame spacing. Gasket 62 typically extends beyond the end of gasket retaining member 54. Generally electrode surface material 48 is foraminous as best shown in FIG. 1.

If desired, gasket 62 may be a one piece gasket or a compound gasket, which may be formed of two or more strips of gasketing material as a stepped or a tapered strip. It is believed that gasket 62 performs the function of (a) sealing the joints between frames and membranes and between membranes and frames to form a liquid-tight closure; (b) protecting the membranes from mechanical damage from the electrode surface joint with the frame; and (c) protecting the membranes from any gas penetration which might occur into the electrode mesh of the joint, particularly at the top of the cell.

A corresponding construction 64 may be employed for adjacent frame 44 to provide a matching construction if desired.

Figure 3:
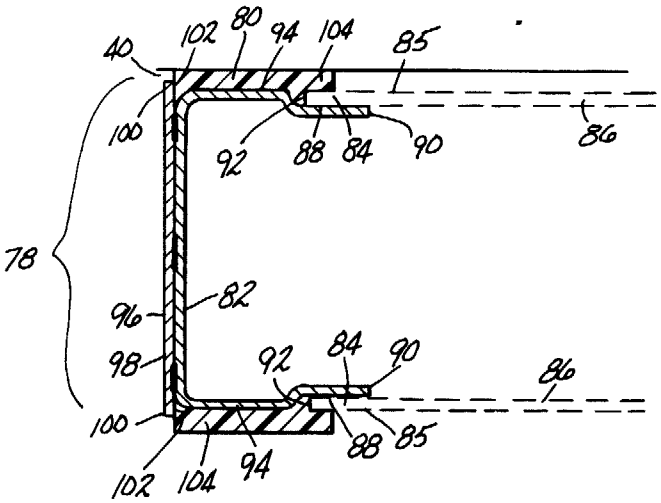
FIG. 3 shows an alternate embodiment of an electrolytic cell assembly having a gasket retaining member.

Referring to FIG. 3, an alternate embodiment of a preferred electrolytic cell assembly 78 comprises a separator 40 formed to fit between adjacent first frame 82 and adjacent second frame (not shown). When in assembled position, a planar layer 84 of foraminous material 86 conforms in shape to first frame 82 and has smaller external dimension than first frame 82. A portion of layer 84 overlaps and is affixed to side 88 on an inwardly offset portion 90 of first frame 82 so as to form an outwardly facing shoulder 92 on side 90 of first frame 82 and whereby the surface 85 of layer 84 closest to an adjacent frame (not shown) preferably is in the same plane with nonoffset portion 94 of side 88.

A gasket retainer member 96 is affixed to the outside 98 of first frame 82 and has at least one straight projection 100 beyond nonoffset portion 94 toward second adjacent frame (not shown) so as to form an inwardly facing shoulder 102 on side 94 of first frame 82. A gasket 104 is adapted to fit against side 94 of first frame 82 and between outwardly facing shoulder 92 and inwardly facing shoulder 102 so as to seal the space between outwardly facing shoulder 92, side 94, inwardly facing shoulder 102 and separator 40.

Figure 4:
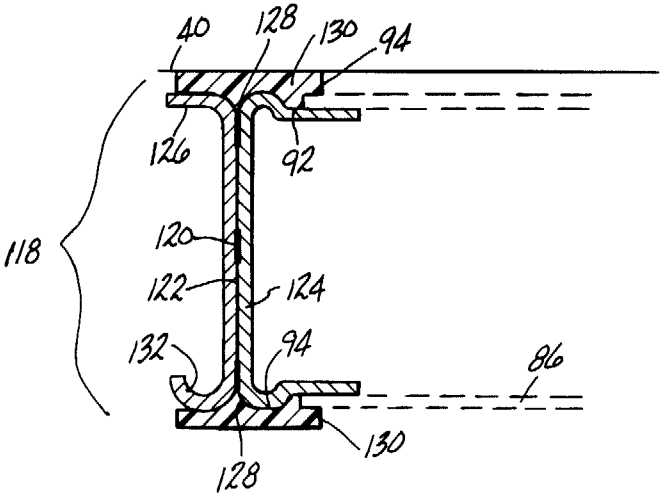
FIG. 4 shows another alternate embodiment of an electrolytic cell assembly having a gasket retaining member.

Referring to FIG. 4, a preferred electrolytic cell assembly 118 is the same as referred to in FIG. 3 except that gasket retainer member 120 is affixed to the outside face 122 of first frame 124 and has at least one projection 126 opposite side 122 as to form a groove 128 which is triangular shaped. A gasket 130 is adapted to fit against side 92 of first frame 124 and in groove 128 so as to seal the space (not shown) between outwardly facing shoulder 94, groove 128, separator 40. If desired, projection 132 opposite side 122 may be a curved shape.

Gasket retainer member 120 and frame 124 may be formed by joining two relatively straight planar strips of thin metal, for example, thin titanium. Preferably, the strips are of different width. The strips may be joined face to face by resistance welding. After joining, the wider of the two strips (now joined as one), is formed to a U shape with the thinner of the two strips remaining as original configuration or bent if desired. The resulting joined strips may form a U shape. An edge of foraminous surface is attached preferably by resistance welding to a portion of the wide and bent strip so as to form an outwardly facing shoulder thereon.

Resistance welding of the strips may be spot, dashed, or continuous. Preferably welds should be near the bends as possible to better withstand the spreading effect of gasket pressure. Welds along the midline of the channel, may or may not be required, depending upon structural considerations.

Separator 40 which can be employed with the electrodes of the present invention include inert, flexible membranes having ion exchange properties and which are relatively impervious to the hydrodynamic flow of the electrolyte and the passage of gas products produced in the cell. Suitably used are cation exchange membranes such as those composed of fluorocarbon polymers having a plurality of pendant sulfonic acid groups or carboxylic acid groups or mixtures of sulfonic acid groups and carboxylic acid groups. The terms "sulfonic acid groups" and "carboxylic acid groups" include salts of sulfonic acid or salts of carboxylic acid which are suitably converted to or from the acid groups by processes such as hydrolysis. One example of a suitable membrane material having cation exchange properties is a perfluorosulfonic acid resin membrane composed of a copolymer of a polyfluoroolefin with a sulfonated perfluorovinyl ether. The equivalent weight of the perfluorosulfonic acid resin is from about 900 to about 1600 and preferably from about 1100 to about 1500. The perfluorosulfonic acid resin may be supported by a polyfluoroolefin fabric. A composite membrane sold commercially by E. I. duPont deNemours and Company under the trademark "Nafion" is a suitable example of this membrane.

A second example of a suitable membrane is a cation exchange membrane using a carboxylic acid group as the ion exchange group. These membranes have, for example, an ion exchange capacity of 0.5–4.0 mEq/g of dry resin. Such a membrane can be produced by copolymerizing a fluorinated olefin with a fluorovinyl carboxylic acid compound as described, for example, in U.S. Pat. No. 4,138,373, issued Feb. 6, 1979, to H. Ukihashi et al. A second method of producing the above-described cation exchange membrane having a carboxyl group as its ion exchange group is that described in Japanese Patent Publication No. 1976-126398 by Asahi Glass Kabushiki Gaisha issued Nov. 4, 1976. This method includes direct copolymerization of fluorinated olefin monomers and monomers containing a carboxyl group or other polymerizable group which can be converted to carboxyl groups. Carboxylic acid type cation exchange membranes are available commercially from the Asahi Glass Company under the trademark "Flemion".

Spacers may be placed between the electrode surfaces and the membrane to regulate the distance between the electrode and the membrane and, in the case of electrodes coated with platinum group metals, to prevent direct contact between the membrane and the elctrode surface.

The spacers between the membrane and the electrode surfaces are preferably electrolyte-resistant netting having openings which are preferably about ¼" in both the vertical and horizontal directions so as to effectively reduce the interelectrode gap to the thickness of the membrane plus two thicknesses of netting. The netting also restricts the vertical flow of gases evolved by the electrode surfaces and drives the evolved gases through the mesh and into the center of the hollow electrodes, since the netting has horizontal as well as vertical mesh.

Figure 5:
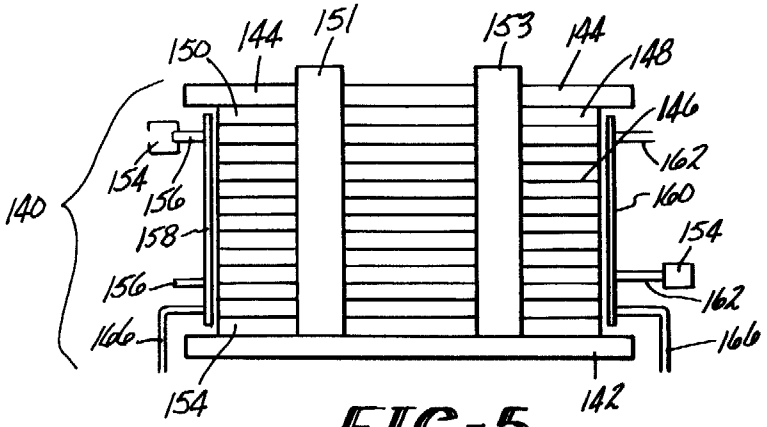
FIG. 5 is a plan view of a preferred filter press cell employing the novel electrode and electrolytic cell assembly of this invention.

Briefly, FIG. 5 shows a top view of a preferred filter press cell 140 which comprises a front end plate 142, a back end plate 144, with a plurality of interleaved anode frames 146 and cathode frames 148 alternately spaced therebetween. Suitable electrolytic separators (not shown) such as ion exchange membranes (not shown) are employed between anode frames 146 and cathode frames 148. Suitable support means such as tie bolts (not shown) are employed to secure the filter press cell 140 is a sealed position. Suitable spacers (not shown) are employed between anode frames 146 and cathode frames 148. Suitable spacers (not shown) are employed between rear cathode frame 150 and rear end plate 144, between front cathode frame 152 and front end plate 142, and between membranes (not shown) and anode frame 146. The electrodes (not shown) of this invention are connected to both anode frames 146 and cathode frames 148 as has been previously described with reference to FIG. 1. The electrolytic cell assembly is employed to obtain a liquid-tight sealing of the membrane (not shown) anode frames 146 and cathode frames 148 as previously described with reference to FIG. 2.

Cylindrical gas disengagers 151 and 153 with dished heads are provided for medium pressure operation. Gas connections (not shown) from each anode frame 146 and cathode frame 148 are made directly to the anode disengager 151 and the cathode disengager 153 respectively; whereas the recycled electrolytes (not shown) are returned through single return lines (not shown) through individual inlets (not shown) at the bottom of each anode frame 146 and cathode frame 148.

In operation, the filter press cell 140 is connected electrically in series with other similar filter press cells (not shown). Typically, electric current is supplied from intercell connector 154 to anode terminal 156 which conveys the current to anode distributor plate 158 which in turn conveys the current to anode conductor rods (not shown) attached to anode frames 146 and thereafter to novel electrodes (not shown) of this invention employed as anodes (not shown) in filter press cell 140. The electric current then passes through the electrolytic solution (not shown) contained within the anode frames 146 to the electrolytic solution (not shown) contained within cathode frames 148. Thereafter the current passes to cathodes (not shown) and thereafter to conductor rods (not shown) within cathode frames 148 and thereafter to the cathode collector plate 160. Cathode terminal 162 is connected to cathode collector plate 160. Cathode terminal 162 is in turn connected to intercell connector 154 which conveys current to an anode terminal (not shown) of an adjacent filter press cell (not shown). Jumper connection 166 is employed to electrically bypass a selected filter press cell 2 should maintenance be desired on that cell.

Figure 6:
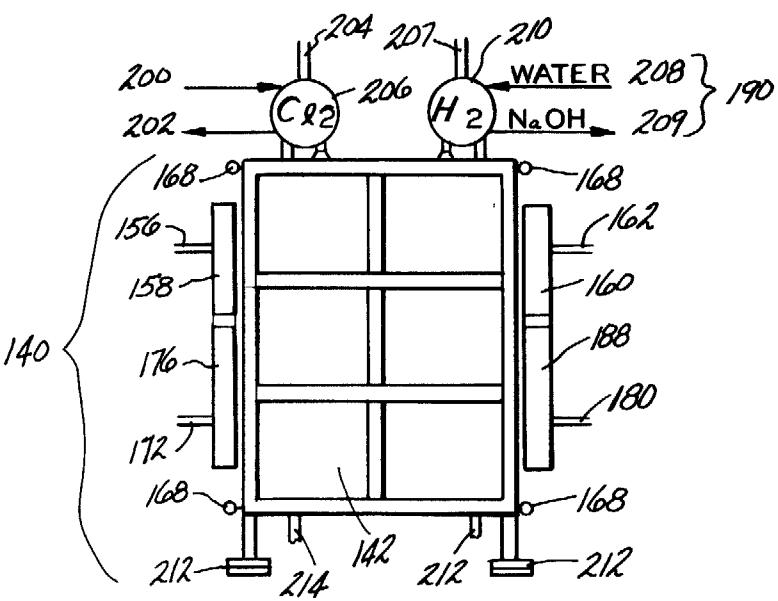
FIG. 6 is a front elevation view of the cell of FIG. 5.

FIG. 6 is a front elevational view of preferred filter press cell 140 which suitably employs the novel electrode (not shown) and electrolytic cell assembly (not shown) of this invention.

Filter press cell 140 comprises a front end plate 142, a plurality of tie bolts 168, an upper anode terminal 156, a lower anode terminal 172, an upper anode distributor 158, a lower anode distributor 176, and upper cathode terminal 162, a lower cathode terminal 180, an upper cathode collector 160 and a lower cathode collector 188, and a material supply and withdrawal system 190.

System 190 in turn comprises a fresh brine supply conduit 200, spent brine withdrawal conduit 202, chlorine outlet conduit 204, anolyte disengager 151, water supply conduit 208, a catholyte disengager 153 and catholyte product conduit 209. Chlorine outlet conduit 204 and hydrogen outlet conduit 207 are thereafter connected to respective chlorine and hydrogen handling systems (not shown).

Cell 140 is supported on support legs 212 and is provided with an anolyte drain/inlet line 214 and a catholyte drain/inlet line 216. Lines 214 and 216 are valved drain lines connected to each frame (not shown) in order to allow anolyte and catholyte to be drained from anodes, and cathodes, respectively. Alternatively, lines 214 and 216 can also be connected to anolyte disengager 151 and catholyte disengager 153, respectively, in order to provide a recirculation path for disengaged anolyte and catholyte liquids.

The preferred method of operation is to maintain the gas pressures in the separators at a common pressure with an entire circuit of cells and to maintain the cell bodies under essentially the same pressure. (There is, of course, a hydraulic pressure gradient within both anolyte and catholyte compartments of the cells.) Gas pressures are automatically controlled at the desired levels with a suitable, closely controlled, differential between chlorine and hydrogen. This procedure allows reduced pipe line sizes, conserves the pressure energy in the gases, and simplifies instrumentation. Recycle of electrolytes is, preferably, handled on a unit cell basis, as a convenient method of control. Alternatively, recycle should be handled on an individual compartment basis, or on the basis of an entire circuit.

While the advantages from this invention are most noticeably derived at medium pressure, an electrolytic cell employing this invention may also be suitably operated at a pressure from about 14.7 to about 16 pounds absolute pressure per square inch.

There are several advantages to this invention. Thin-wall resistant metal fabrication has been made practical and economic, for medium pressure cells. Also, the same concepts may be employed for improved cells for operation at low, or atmospheric pressure. Use of the electrode mesh to provide stiffness to the electrode frame permits the use of frame structural members with a small section modulus, i.e., with a narrow width in the plane of the electrode. The frame elements combine to serve a number of functions in an inexpensive and effective manner. Functions are: fluid containment under pressure, gasket retention, gasket support, and membrane protection.

Some advantages of pressure cells, which this design assists are:

(a) Operating temperatures may be raised, decreasing electrolyte resistances, making heat recovery more practicable, and making higher current densities practicable without damage to the membrane.

(b) Gas volumes are greatly decreased, resulting in reduced turbulence in the cell, requiring smaller gas pipe lines, and reducing, or eliminating gas compression requirements.

(c) The thinner electrode frames result in a thinner assembled cell that produces less expansion and contraction of the anode distributors and cathode collectors during operation.

(d) The narrower the thickness of the cell's electrode frames the more capacity each individual cell can have in a given operating floor space and, hence, the greater can be capacity of the entire plant in a given operating floor space.

While the preferred structure in which the principles of the present invention have been incorporated is shown and described above it is to be understood that the invention is not to be limited to the particular details thus presented, but in fact, widely different means may be employed in the practice of the broader aspects of this invention. The scope of the appended claims is intended to encompass all obvious changes in the details, materials and arrangement of parts which will occur to one of skill in the art upon a reading of the disclosure.

Having thus described the invention, what is claimed is:

1. An electrode for a filter press membrane electrolytic cell, said electrode comprising:

(a) a frame having two side members, a top member and a bottom member, said frame being generally rectangular in shape and having a predetermined tensile strength and predetermined thickness;

(b) at least two vertical planar foraminous electrode surfaces of a second predetermined tensile strength conforming in shape to said frames, said surfaces being in spaced-apart parallel relationship thereby defining a plane through each of said surfaces, each of said surfaces further having a periphery defining said shape, said periphery being reinforcingly connected to said frame such that the predetermined tensile strength of said frame is at least equal to the second predetermined tensile strength of each of said surfaces in the direction of the plane of each of said surfaces;

(c) a chamber formed between said surfaces and bounded by said frame;

(d) said foraminous electrode surfaces having a predetermined surface area such that the ratio of the predetermined surface area to the thickness of the frame is in the range of about $12.05 \times 10^4$ linear units to about $0.08 \times 10^4$ linear units;

(e) at least one process connection connected to said frame for conveying material into said chamber;

(f) at least one process connection connected to said frame for conveying material out of said chamber; and (g) at least one conductor rod passing through one of said side members of said frame into said chamber, said conductor rod being attached to said foraminous surfaces.

2. The electrode of claim 1, wherein said frame is square in shape.

3. The electrode of claim 1, in which said foraminous surface is comprised of a metal form selected from the group consisting of wire mesh, expanded metal mesh, perforated sheet, slit sheet, louvered sheet and the like.

4. The electrode of claim 1, in which said foraminous surface is comprised of expanded metal mesh.

5. The electrode of claim 1, in which said frame has a tensile strength in the range from about 1200 to about 6000 pounds per lineal inch.

6. The electrode of claim 1, wherein said frame comprises channel.

7. The welded connection of claim 1, wherein said process connections are welded connections.

8. The electrode of claim 3, wherein said process connections are lap welded connections.

9. The electrode of claim 4, wherein said mesh has a thickness in the range from about 0.03 to about 0.10 inches and has a tensile strength in the range from about 50 to about 300 pounds per lineal inch.

10. The electrode of claim 4, wherein said mesh has a thickness in the range from about 0.05 inches to about 0.08 inches and has a tensile strength in the range from about 50 to about 300 pounds per lineal inch.

11. The electrode of claims 9 or 10 wherein said mesh has multiple openings therein, said openings having a length to width ratio in the range from about 5:1 to about 1:1.

12. The electrode of claim 1, wherein said frame further has a predetermined height and a predetermined length.

13. The electrode of claim 12 wherein said predetermined height is in the range of about 0.5 meters to about 4.0 meters.

14. The electrode of claim 12 wherein said predetermined length is in the range of about 0.5 meters to about 3.0 meters.

15. The electrode of claim 5 wherein said frame members are of a predetermined thickness in the range of about 0.05 inches to about 0.25 inches.

16. The electrode of claim 15, wherein said frame members have a thickness in the range from about 0.08 to about 0.15 inches.

17. The electrode according to claim 3 wherein each member of the frame has two opposing exterior surfaces.

18. The electrodes according to claim 3 wherein said foraminous surfaces are reinforcingly connected to the exterior surfaces to provide structural stiffness to the frame to contain the hydraulic pressure within.

* * * * *